US005463271A

United States Patent [19]

Geis et al.

[11] Patent Number: 5,463,271

[45] Date of Patent: Oct. 31, 1995

[54] STRUCTURE FOR ENHANCING ELECTRON EMISSION FROM CARBON-CONTAINING CATHODE

[75] Inventors: Michael W. Geis, Acton, Mass.; John M. Macaulay, Palo Alto, Calif.; Jonathan C. Twichell, Acton, Mass.

[73] Assignees: Silicon Video Corp., Cupertino, Calif.; Massachusetts Institute of Technology, Cambridge, Mass.

[21] Appl. No.: 90,228

[22] Filed: Jul. 9, 1993

[51] Int. Cl.[6] ..... H01J 1/30; H01J 19/24

[52] U.S. Cl. ..... 313/346 R; 313/310; 257/77; 257/11

[58] Field of Search ..... 313/346 R, 346 DC, 313/310, 345, 355, 270, 337, 311, 336, 351; 257/77, 103, 10, 11, 12

[56] References Cited

U.S. PATENT DOCUMENTS

| | | | |
|---|---|---|---|
| 4,411,827 | 10/1983 | Corneille | 252/521 |
| 4,663,559 | 5/1987 | Christensen | 313/346 R X |
| 5,019,003 | 5/1991 | Chason | 445/24 |
| 5,089,292 | 2/1992 | Macaulay et al. | 313/346 R X |
| 5,180,951 | 1/1993 | Dworsky et al. | 313/346 R X |
| 5,190,796 | 3/1993 | Incovangelo | 427/304 |
| 5,202,571 | 4/1993 | Hirabayashi et al. | 313/346 R X |

OTHER PUBLICATIONS

Langmuir, "Oxygen Films on Tungsten. I. A Study of Stability by Means of Electron Emission in Presence of Cesium Vapor," *J. Amer. Chem. Soc.*, Feb. 1931, pp. 487–497.

Lin, "The role of oxygen and fluorine in electron emission of some kinds of cathodes," *J. Vac. Sci. Technol.*, May/Jun. 1988, pp. 1053–1057.

Macaulay et al, "Cesiated thin-film field-emission microcathode arrays," *Appl. Phys. Lett.*, 24 Aug. 1992, pp. 997–999.

Rougeot et al, "Negative Electron Affinity Photoemitters," *Adv. Electronics & Electron Phys.*, vol. 48, 1979, pp. 1–36.

Levine, "Structural and Electronic Model of Negative Electron Affinity on the Si/Cs/O Surface," *Surf. Sci.*, 1973, pp. 90–107.

Kultashev, "Effect of Oxygen On The Work Function of Films of Electropositive Metals Adsorbed on 4D- And 5D-Transition Metals," *Izevestiya Akademii Nauk SSSR, Seriya Fizicheskaya*, 1976, pp. 2478–2483.

Spicer et al, "Studies of the Semiconducting Properties of the Compound CsAu," *Physical Rev.*, 1 Jul. 1959, pp. 57–62.

Wertheim et al, "Electronic Structure of CsAu," *Solid State Coms.*, vol. 30, 1979, pp. 473–475.

Koenig et al, "Electronic Properties of alkali-metal-gold compounds," *Physical Rev. B*, 15 Jun. 1984, pp. 6481–6488.

*Primary Examiner*—Sandra L. O'Shea
*Assistant Examiner*—Ashok Patel
*Attorney, Agent, or Firm*—Skjerven, Morrill, MacPherson, Franklin & Friel; Alan H. MacPherson; Ronald J. Meetin

[57] ABSTRACT

A cathode structure contains electronegative atoms (22), which consist of oxygen and/or fluorine, chemically bonded to a carbon-containing cathode (10). Atoms (24R) of electropositive metal are chemically bonded to the electronegative atoms. The combination of the electropositive metal atoms and the electronegative atoms enhances the electron emissivity by reducing the work function.

24 Claims, 6 Drawing Sheets

STRUCTURE FOR ENHANCING ELECTRON EMISSION FROM CARBON-CONTAINING CATHODE

This invention was made with government support under Contract Number F19628-90-C-0002 awarded by the Air Force. The U.S. government has certain rights in the invention.

FIELD OF USE

This invention relates to electron-emitting devices and, more particularly, to structures and methods for increasing the electron emissivity of cathodes suitable for devices such as flat-panel cathode-ray tubes.

BACKGROUND ART

An emissive cathode is an electronic device that emits electrons during processes such as field emission, thermionic emission, and photoemission. For example, in field emission, electrons are extracted from an emissive cathode when it is subjected to an electric field of sufficient strength. The electric field is created by applying a voltage between the cathode and an electrode, commonly referred to as the anode or gate electrode, situated a short distance away from the cathode.

Emissive cathodes have been made from tungsten substrates with thin films of cesium deposited over the tungsten. The cesium lowers the cathode work function so as to increase the emission of electrons. Unfortunately, the cesium in a Cs-W cathode tends to evaporate if the cathode is subjected to high temperature, typically 200° C. or more. The electron emissivity severely degrades.

Langmuir et al, "Oxygen Films on Tungsten I. A Study of Stability by Means of Electron Emission in Presence of Cesium Vapor," *J. Amer. Chem. Soc.*, Feb. 1931, pp. 487–497, found that the evaporation problem could be substantially overcome by installing a thin layer, essentially a monolayer, of oxygen between the tungsten and cesium. Oxygen forms very strong chemical bonds with both tungsten and cesium. As a result, exposure at high temperature would not cause the cesium to evaporate away.

In addition, the work function of a Cs-O-W cathode is usually less than that of an otherwise equivalent Cs-W cathode despite the fact that oxygen by itself increases the work function. The interaction of cesium and oxygen more than compensates for the work function-increasing effect of oxygen. Consequently, a Cs-O-W cathode also has a greater electron emissivity than a Cs-W cathode.

Lin, "The role of oxygen and fluorine in electron emission of some kinds of cathodes," *J. Vac. Sci. Technol.*, May/June 1988, pp. 1053–1057, investigated an emissive cathode in which a thin barium film was used in place of the cesium film to form a Ba-O-W cathode having a low work function. Lin also considered replacing the tungsten substrate in his Ba-O-W cathode with another $6s^2$ metal or with a $6s^1$ metal such as gold or platinum.

Macaulay et al, "Cesiated thin-film field-emission microcathode arrays," *Appl. Phys. Lett.*, Aug. 24, 1992, pp. 997–999, found that forming thin cesium coatings on molybdenum cathode tips reduced the work function. U.S. Pat. No. 5,089,292, also to Macaulay et al, discloses a technique for creating such Cs-coated cathodes. In this patent, Macaulay et al specify that the Cs coating could be replaced with a coating of barium, thorium, strontium, sodium, or potassium.

Emissive cathodes utilizing semiconductor substrates have been investigated. For example, Rougeot et al, "Negative Electron Affinity Photoemitters," *Adv. Electronics & Electron Phys.*, Vol. 48, 1979, pp. 1–36, reported on emissive cathodes having gallium arsenide substrates coated with composite films of cesium and oxygen. Levine, "Structural and Electronic Model of Negative Electron Affinity on the Si/Cs/O Surface," *Surf. Sci.*, 1973, pp. 90–107, examined a complex coating of cesium and oxygen on a silicon substrate.

Emissive cathodes are employed in cathode-ray tubes of both the conventional conical type and the new flat-panel type. One requirement for certain flat-panel applications is that an emissive cathode be sealed in a highly evacuated tube at 400° C. It is desirable that the fabrication of the cathode be complete before being placed in the tube so as to avoid contamination from materials used in fabricating the cathode. Consequently, the cathode must be capable of being subjected to one atmosphere of air for 1–2 days without undergoing significant degradation as time passes. The foregoing prior art emissive cathodes are not capable of meeting these specifications while simultaneously having long lifetimes and high emissivities that can be readily controlled during cathode fabrication.

GENERAL DISCLOSURE OF THE INVENTION

The present invention furnishes a structure and method for enhancing the emission of electrons from a carbon-containing emissive cathode. The cathode structure of the invention can typically withstand being raised to 400° C. and being exposed to the atmosphere for 1–2 days. The present cathode structure also has a high, readily controllable emissivity and appears capable of having a long life. Accordingly, the structure is particularly suitable for use in flat-panel cathode-ray tubes sealed at 400° C.

The structure of the invention utilizes electronegative matter and electropositive metal. Electronegativity refers to the power of an atom to attract electrons for creating chemical bonds. The electronegative matter in the present structure thus consists of matter that attracts electrons to form bonds. Electropositivity, on the other hand, refers to the power of an atom to release electrons for creating chemical bonds. Accordingly, the electropositive metal in the structure consists of metal that releases electrons to form bonds.

The electronegative matter is typically oxygen. However, the electronegative matter can be fluorine by itself or in combination with oxygen. The electronegative matter is chemically bonded to the carbon-containing cathode. This is accomplished by subjecting the cathode to the electronegative matter in dissociated form using a technique such as a plasma.

The electropositive metal is chemically bonded to the electronegative matter. This bonding is achieved by suitably subjecting the cathode to the electropositive metal. As a result, an atom of the electronegative matter normally forms bonds with both an atom of the carbon-containing cathode and an atom of the electropositive metal. The combination of the electropositive metal and electronegative matter enhances the electron emission from the cathode by reducing its work function.

More particularly, the cathode has an electron-emissive surface along which the cathode consists of at least 50 atomic percent carbon, preferably diamond. Although pure diamond is an electrical insulator, various techniques can be employed to make the diamond electrically conductive along the electron-emissive cathode surface. For example, a doping technique can be employed. Alternatively, the crystal structure of the diamond can be damaged slightly. In addition, the carbon along the electron-emissive surface can include graphite and/or amorphous carbon, both of which are naturally conductive.

When the cathode is subjected to the dissociated electronegative matter, a specified area of the electron-emissive surface becomes terminated in the electronegative matter, normally in a monolayer of atoms of the electronegative matter. The electropositive metal is bonded to the electronegative matter gas along the specified area. The electropositive metal likewise normally consists of a monolayer of metal atoms. If more than a monolayer of metal atoms accumulates along the specified area when the cathode is subjected to the metal, a heating step is subsequently performed to remove the excess metal.

The electropositive metal is typically cesium, barium, potassium and/or sodium. Additional candidates for the metal include lithium, rubidium, scandium, yttrium, and lanthanum.

Regions of an alloy of the electropositive metal and a noble metal such as gold may be situated along the cathode. To create gold alloy regions, regions of gold are created over parts of the electron-emissive surface (exclusive of the specified area) before the cathode is subjected to the electronegative matter and electropositive metal. The gold regions are then converted to the alloy during the metal-subjecting step and/or the later heating step. The alloy regions serve as a reservoir for the electropositive metal.

One of the benefits of using carbon in the present cathode structure is that, unlike most other materials which have been used as the substrates in prior emissive cathodes, only a monolayer of adjoining matter is chemically bonded to the the carbon along the electron-emissive surface. As a result, the cathode structure of the invention has a well-controlled emission characteristic.

BRIEF DESCRIPTION OF THE DRAWINGS

FIGS. 1*a*, 1*b*, 1*c*1, 1*c*2, and 1*d* are cross-sectional views representing steps in fabricating an emissive cathode structure according to one embodiment of the invention.

FIGS. 2*a*, 2*b*, 2*c*, 2*d*1, 2*d*2, and 2*e* are cross-sectional views representing steps in fabricating an emissive cathode structure according to another embodiment of the invention.

Figure 1A:
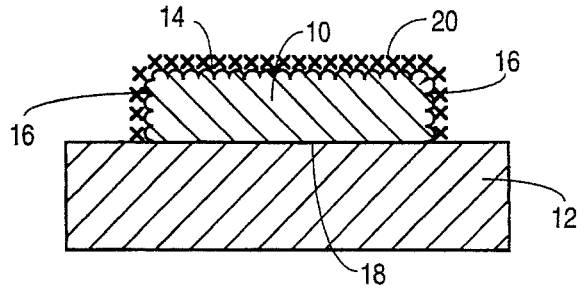

The sizes and shapes of the structures shown in FIGS. 1*a*–1*d*, 2*a*–2*e*, and 3 are schematic in nature. The thicknesses of layers created during the fabrication processes are greatly exaggerated in these drawings for illustrative purposes.

Like reference symbols are employed in the drawings and in the description of the preferred embodiments to represent the same or very similar item or items.

DESCRIPTION OF THE PREFERRED EMBODIMENTS

Referring to FIGS. 1*a*–1*d*, they illustrate a general procedure for manufacturing an emissive cathode structure according to the teachings of the invention. This cathode structure can be utilized in photoemissive, thermionic emissive, and field emissive applications, especially in flat-panel cathode-ray tubes.

At the initial stage indicated in FIG. 1*a*, an electron-emissive main cathode 10 is mounted on an electrically conductive supporting piece 12. Both cathode 10 and supporting piece 12 are situated in a vacuum chamber (not shown). In fact, supporting piece 12 is one of the fixtures in the vacuum chamber.

Cathode 10 is a carbon-containing substrate having an electron-emissive surface consisting of upper surface 14 and lateral surface 16. The convolution along electron-emissive surface 14/16 represents the cathode atoms at surface 14/16.

Along electron-emissive surface 14/16, substrate 10 is at least 50 atomic percent carbon distributed in a largely uniform manner. Preferably, substrate 10 is substantially 100 atomic percent carbon along surface 14/16. The carbon along surface 14/16 is electrically conductive.

Electrically conductive carbon may be distributed throughout substrate 10 in a largely uniform manner. In this case, substrate 10 is also electron-emissive along its lower surface 18 in contact with supporting piece 12. On the other hand, substrate 10 may have one or more interior regions which do not contain electrically conductive carbon and which may not even be electrically conductive.

The carbon along surface 14/16 preferably consists substantially of diamond. The carbon can also be in graphite or amorphous form. Furthermore, the carbon along surface 14/16 can be a combination of at least two of diamond, graphite, and amorphous carbon.

In the case of diamond, a variety of doping techniques can be employed to make the diamond electrically conductive along surface 14/16. For example, the diamond can be doped with a standard n-type semiconductor impurity such as arsenic and/or phosphorus. Similarly, the diamond can be doped with a standard p-type semiconductor impurity such as boron. The diamond can also be conductively doped with lithium, nitrogen, and/or sulfur.

Alternatively, the diamond along electron-emissive surface 14/16 can be made electrically conductive by causing a slight amount of damage to the diamond crystal structure. For example, carbon can be ion implanted into a diamond. A laser can be utilized to modify the diamond crystal structure by creating nanometer-scale regions of conductive carbon.

Substrate 10 is thoroughly cleaned before being inserted into the vacuum chamber and mounted on supporting piece 12. During the cleaning procedure, electron-emissive surface 14/16 becomes terminated in a thin layer, typically a monolayer, of disassociated gas such as oxygen or hydrogen. Upon exposure to air at the end of the cleaning procedure, the termination layer on surface 14/16 is normally modified. Item 20 in FIG. 1*a* is the resulting termination layer. A similar termination layer (not shown) normally lies along bottom surface 18 between substrate 10 and supporting piece 12.

The vacuum chamber in which cathode 10 has been placed after the cleaning operation is pumped down to a low pressure. Electron-emissive surface 14/16 is then subjected to a plasma formed with electronegative matter preferably consisting of dissociated oxygen. Alternatively, the electronegative matter can consist of dissociated fluorine by itself or in combination with oxygen. In regard to fluorine, see Lin, cited above.

Electron-emissive surface 14/16 is exposed to the plasma for a time long enough to terminate surface 14/16 in a layer 22 of the electronegative matter. See FIG. 1*b*. In doing so, earlier termination layer 20 is largely removed to the extent that it does not already consist of the electronegative matter provided, for example, during the cleaning procedure and/or the subsequent exposure to air.

Figure 1B:
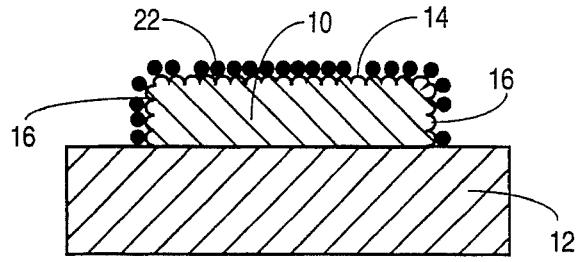

Termination layer 22 is basically a monolayer of atoms of the electronegative matter. These atoms, which are represented by dark circles in FIG. 1*b*, form strong chemical bonds with the carbon along surface 14/16. Layer 22 is usually discontinuous. That is, there are atomic-scale gaps where no atoms of the electronegative matter are chemically bonded to the carbon along surface 14/16. FIG. 1*b* illustrates several such gaps.

After the plasma step has been completed and without opening the vacuum chamber, cathode 10 is subjected to electropositive metal at low pressure to form a layer 24 of the metal over electronegative-matter layer 22. FIGS. 1*c*1 and 1*c*2 illustrate this metal-subjecting step in which the metal atoms are represented by light circles. The metal atoms that accumulate directly on the atoms of the electronegative matter in layer 22 react with those atoms to form strong chemical bonds.

The electropositive metal that forms layer 24 preferably consists of cesium, barium, potassium, and/or sodium. The electropositive metal can also include lithium, rubidium, scandium, yttrium, and/or lanthanum. In regard to scandium, yttrium, and lanthanum, see Kultashev et al, "Effect of Oxygen on the Work Function of Films of Electropositive Metals Adsorbed on 4D- and 5D-Transition Metals," *Izevestiya Akademii Nauk SSSR, Seriya Fizicheskaya,* 1976, pp. 2478–2483.

The metal-subjecting step can be performed in a number of ways. One principal technique is vapor deposition such as evaporation. If a substantially pure source of the electropositive metal is available, the metal can be evaporated onto termination layer 22 over cathode 10 by heating the metal source to a sufficiently high temperature. Evaporation can also be used when the electropositive metal is available in the form of a metal salt from which the metal dissociates when the salt is raised to a high enough temperature. In both cases, evaporative deposition is performed at very low chamber pressure. Low-pressure chemical vapor deposition can also be used for creating metal layer 24.

Another technique is to physically deposit a salt of the electropositive metal directly on electronegative-matter layer 22. The salt is then heated or subjected to radiation such as light to cause the salt to dissociate. Some of the dissociated metal atoms accumulate on layer 22.

The work function along metal layer 24 at the end of the metal deposition is significantly less than the work function along surface 14/16 prior to the metal deposition. The difference in work function is manifested by the capability to achieve a specified electron emission, as indicated by current density, at a considerably reduced electric field when the cathode structure is operated as a field-emission cathode.

Ideally, the growth of metal layer 24 is terminated when layer 24 reaches a monolayer of metal atoms. FIG. 1*c*1 depicts this case. The work function along layer 24 is then close to the minimum value so that the electron emissivity is the greatest. However, as shown in FIG. 1*c*2, layer 24 often reaches a thickness significantly greater than one atom.

Figure 1D:
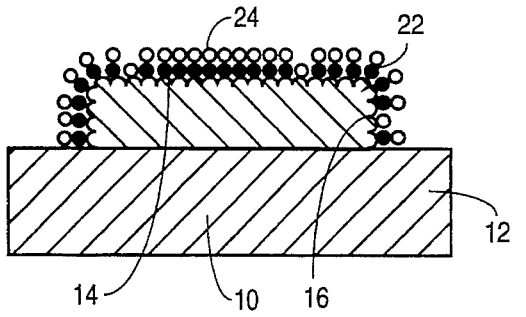
Figure 1D:
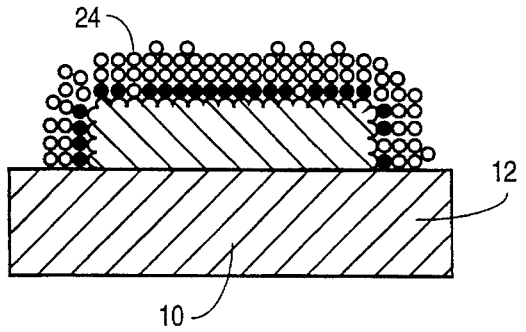
Figure 1D:
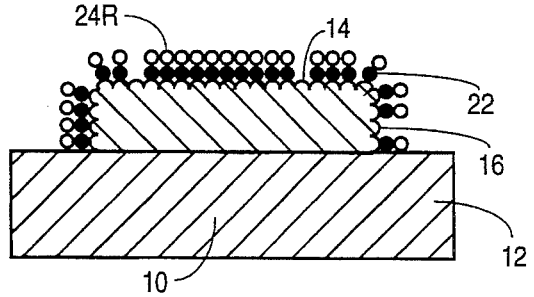

The thickness of metal layer 24 in excess of one atom reduces the electron emissivity. Accordingly, without opening the vacuum chamber after completing the metal-subjecting step, substrate 10 is heated to a temperature, and for a time, sufficient to cause the metal atoms in excess of one monolayer to evaporate away. This step is also done at low pressure. FIG. 1*d* illustrates the resulting cathode structure in which item 24R is the resulting monolayer of metal atoms.

The temperature and time needed to convert layer 24 into monolayer 24R depends somewhat on the particular metal (or combination of metals) chosen for the electropositive metal. Typically, the chamber temperature, and thus the temperature of substrate 10, is raised to 200° C. and held there for 60 minutes. However, a chamber temperature of 200° C. for several minutes - - - e.g., 3 minutes - - - should be adequate to remove the excess metal atoms. A chamber temperature as low as 100° C. appears sufficient when the electropositive metal consists of a metal, such as cesium, having a high vapor pressure.

Before opening the vacuum chamber, substrate 10 is preferably subjected to oxygen and/or fluorine in molecular form - - - i.e., $O_2$ and/or $F_2$ - - - at approximately 1 atm. The chamber is then opened for removing the completed cathode structure.

In the exemplary process of FIGS. 1*a*–1*d*, electronegative-matter layer 22 is formed on all of electron-emissive surface 14/16. Alternatively, part of surface 14/16 could be masked so that layer 22 forms only on the unmasked part. In general, layer 22 is created on a "specified area" of surface 14/16 where the specified area is part or all of surface 14/16 depending on whether any of it is masked.

FIGS. 2*a*–2*e* illustrate another general procedure for manufacturing an emissive cathode structure according to the invention. The process depicted in FIGS. 2*a*–2*d* is a variation of the process shown in FIGS. 1*a*–1*d* in which part of electron-emissive surface 14/16 is effectively masked. Accordingly, electronegative matter and electropositive-metal layers are formed over only part of surface 14/16 in FIGS. 2*a*–2*e*.

Figure 2A:
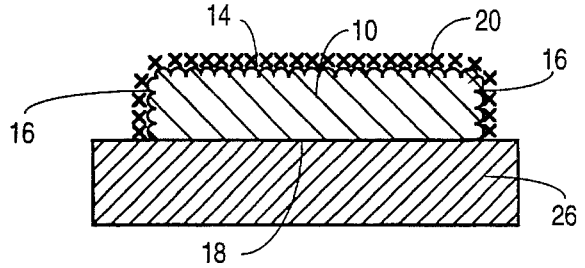

The starting point in FIG. 2*a* is similar to that in FIG. 1*a*. Electron-emissive cathode 10 is mounted on a supporting piece 26 situated in a sputter deposition chamber (not shown). Cathode 10 in FIG. 2*a* has the same characteristics in FIG. 1*a*. That is, substrate 10 is at least 50 atomic percent, preferably 100 atomic percent, carbon along electron-emissive surface 14/16. Substrate 10 has been thoroughly cleaned and subsequently exposed to air with the result that surface 14/16 is terminated in initial gas layer 20.

A noble metal is sputter deposited onto electron-emissive surface 14/16 for a time sufficiently short that the noble metal does not form a continuous layer. Regions 28 of the noble metal are thereby formed on separate parts of surface 14/16 in the manner generally shown in FIG. 2*b*. It appears that the noble metal largely displaces the parts of initial termination layer 20 located where noble-metal regions 28 form. Item 20R in FIG. 2*b* indicates the portion of initial termination layer 20 remaining after the noble-metal deposition.

The noble metal preferably is gold. Regions 28 are then 40–100 angstroms in thickness. Alternatively, the noble metal can be platinum by itself in combination with gold.

Figure 2B:
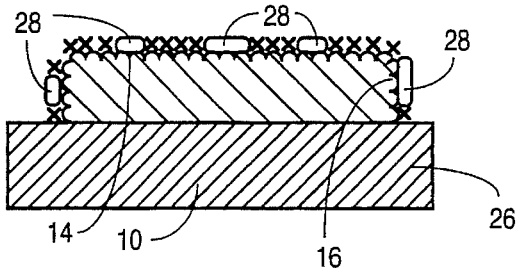

Substrate 10 in FIG. 2*b* is subsequently removed from the sputtering chamber and placed on supporting piece 12 in the vacuum chamber discussed above in connection with FIGS.

Figure 2C:
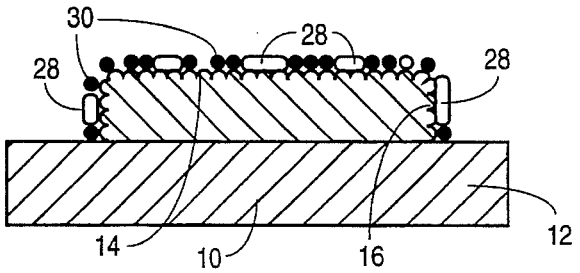
Figure 2E:
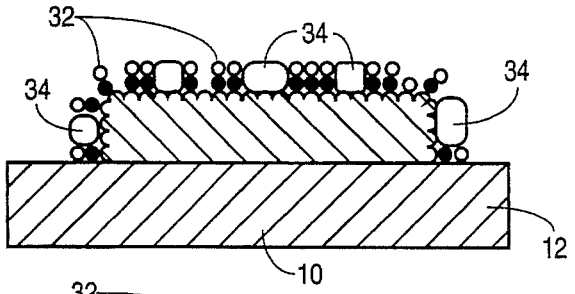
Figure 2E:
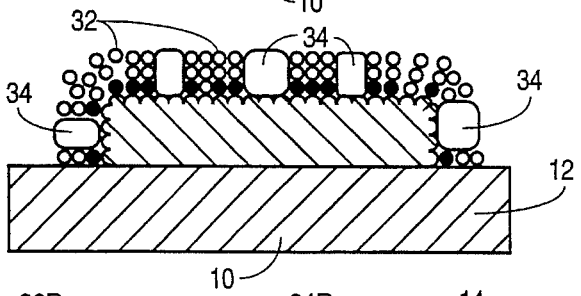
Figure 2E:
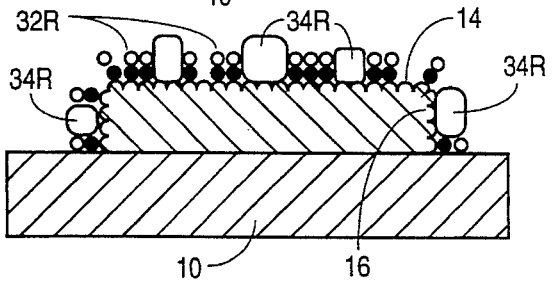

1*a*–1*d*. Letting the portion of electron-emissive surface 14/16 not covered by layer 20 be referred to as the "specified area", the specified area is subjected to a plasma of electronegative-matter consisting of oxygen in largely the same manner as that discussed above for FIG. 1*b*. The exposure to the plasma is thereby performed for a time sufficiently long to remove layer 20R and terminate the specified area in a monolayer 30 of the electronegative matter. FIG. 2*c* depicts the resulting structure in which the electronegative-matter atoms, again shown in dark circles, form strong chemical bonds with the carbon along the specified area.

Gold does not form a stable oxide at low pressure. For the preferred case in which the noble metal is gold, the exposed surface of Au layer 20 thus does not become terminated in oxygen. This exemplary case is illustrated in FIG. 2*c*.

Without opening the vacuum chamber, cathode 10 is subsequently subjected to electropositive metal of the type described above to create a layer 32 of the electropositive metal over electronegative-matter layer 30. FIGS. 2*d*1 and 2*d*2 illustrate this step in which the metal atoms are again represented by light circles. Strong chemical bonds are created between the electronegative-matter atoms in layer 30 and the metal atoms that accumulate directly on the electronegative-matter atoms. As indicated in FIG. 2*d*2, metal layer 32 sometimes reaches a thickness significantly greater than one atom.

The electropositive metal also accumulates on noble-metal regions 28 during the formation of electropositive-metal layer 32. Items 34 in FIGS. 2*d*1 and 2*d*2 indicate the composite formed by the accumulation of the electropositive metal on noble-metal regions 28. If the metal-subjecting step is performed at a sufficiently high temperature, compositive regions 34 consist of an alloy of the noble and electropositive metals. If not (as is usually the case), regions 34 simply consist of the electropositive metal generally overlying the noble metal.

Without opening the vacuum chamber, a heating step is performed at low pressure in a manner similar to that discussed above to remove the thickness of electropositive-metal layer 32 in excess of one atom. See FIG. 2*e*. Item 32R indicates the remaining portion of metal layer 32.

If composite regions 34 do not already consist of an alloy of the noble and electropositive metals, the heating step is performed under conditions adequate to convert regions 34 into an alloy of the noble and electropositive metals. In this case, the chamber temperature is at least 150° C. and typically 200° C. Part of the thickness of regions 34 is also removed during the heating step. Items 34R in FIG. 2*e* denotes the remaining alloyed portions of regions 34. The cathode structure is subsequently taken out of the vacuum chamber.

Figure 3:
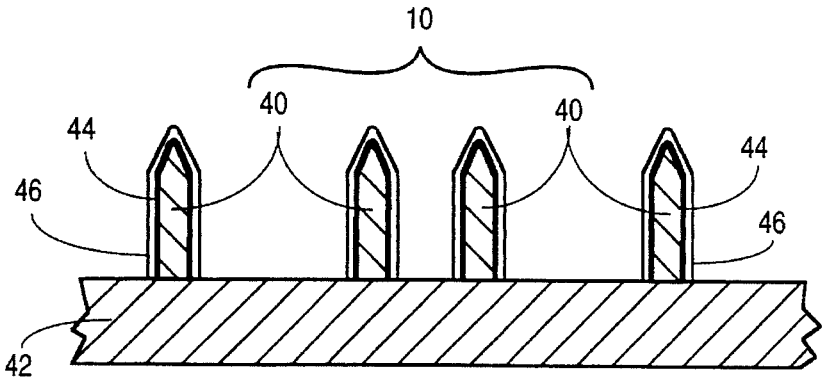
FIG. 3 is a cross-sectional view of a cathode structure that can be fabricated according to the process of FIGS. 1*a*–1*d*.

While cathode 10 has been illustrated as a single body in the previous figures, cathode 10 can be a group of cathode elements. FIG. 3 illustrates an example of such an arrangement in which cathode 10 is a set of electron-emissive pedestals 40 with sharpened tips. Pedestals 40 are interconnected by way of an electrically conductive layer 42. Items 44 and 46 in FIG. 3 respectively represent electronegative-matter layer 22 and electropositive-metal layer 24R of FIG. 1*d*.

Figure 4:
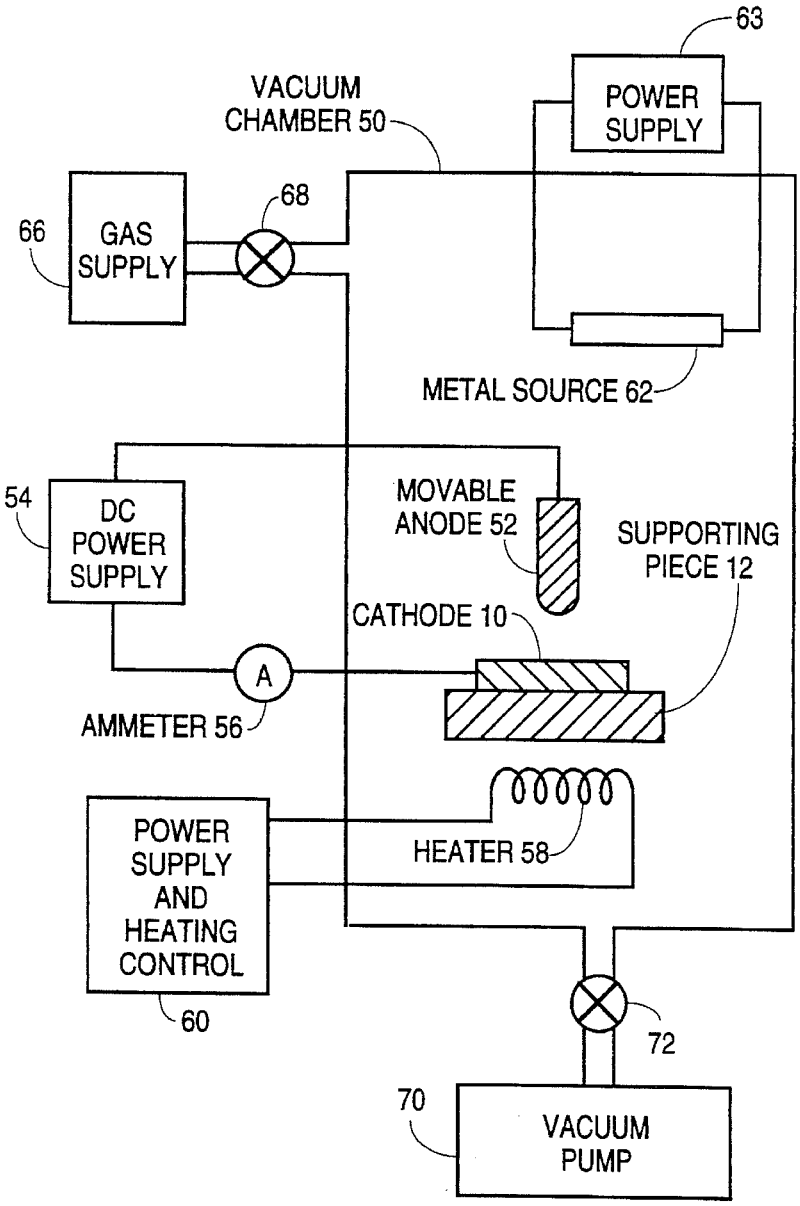
FIG. 4 is a block diagram, partially in cross-sectional view, of a vacuum-chamber system used in the fabrication processes of the present invention.

A number of samples of the cathode structure of the invention have been fabricated using evaporative deposition for subjecting the electropositive metal to cathode 10. Turning to FIG. 4, it shows the system used during the plasma, metal-evaporation, and heating steps for creating these samples. The system consists of an ultra-high vacuum chamber 50, cathode supporting piece 12, a movable anode 52, a variable high-voltage DC power supply 54 for anode 52 and cathode 10, an ammeter 56 for measuring the cathode current, a heater 58, a heater power supply and control unit 60, an evaporative-getter metal source 62, a metal-source power supply 64, a gas supply 66, a gas-control valve 68, a vacuum pump 70, and a pump-control valve 72. An electronic control unit (not shown) is used to operate the system.

For samples in which substrate 10 consisted of pure diamond, the following procedure was used to clean substrate 10 before placing it in vacuum chamber 50: (a) wash in a solution of hydrofluoric and nitric acids, (2) etch in a solution of sulfuric acid and hydrogen peroxide at 150° C., (3) rinse in distilled water, (4) rinse in acetone, and (5) plasma etch at 1 torr for 1 minute in a hydrogen-containing plasma. As a result of the plasma etch, original termination layer 20 consisted largely of hydrogen.

After mounting substrate 10 on supporting piece 12 in chamber 50, the chamber pressure was pumped down to $10^{-6}$ torr. Oxygen from gas supply 66 was introduced into the chamber to bring its pressure up to 1 torr. A discharge was run between anode 52 and chamber 50 (including cathode 10 which was electrically connected to chamber 50) at 2 watts to create an oxygen plasma. Substrate 10, specifically electron-emissive surface 14/16, was exposed to the plasma for 1 minute. Chamber 50 was evacuated to $10^{-9}$ torr after which the emission characteristics of the sample were determined by way of ammeter 56.

Next, a vapor of the electropositive metal was generated by heating metal source 62. The metal was allowed to deposit on gas layer 22 for 1–5 minutes at a vapor pressure of $10^{-9}$–$10^{-8}$ torr. The sample was subsequently heated to 200° C. for 60 minutes or more. Ammeter 56 was used to determine the electron emissivity.

The following operations were performed to test completed cathode structures before removing the samples from chamber 50:

A. A sample was heated to 280°–400° C. for at least 10 minutes. After the sample cooled down, ammeter 56 was employed to determine the emission characteristics.

B. A sample was exposed for 5 minutes to air or to pure molecular oxygen at 1 atm. After chamber 50 was pumped down to approximately $10^{-9}$ torr, ammeter 56 was again utilized to determine the emission characteristics.

Figure 5:
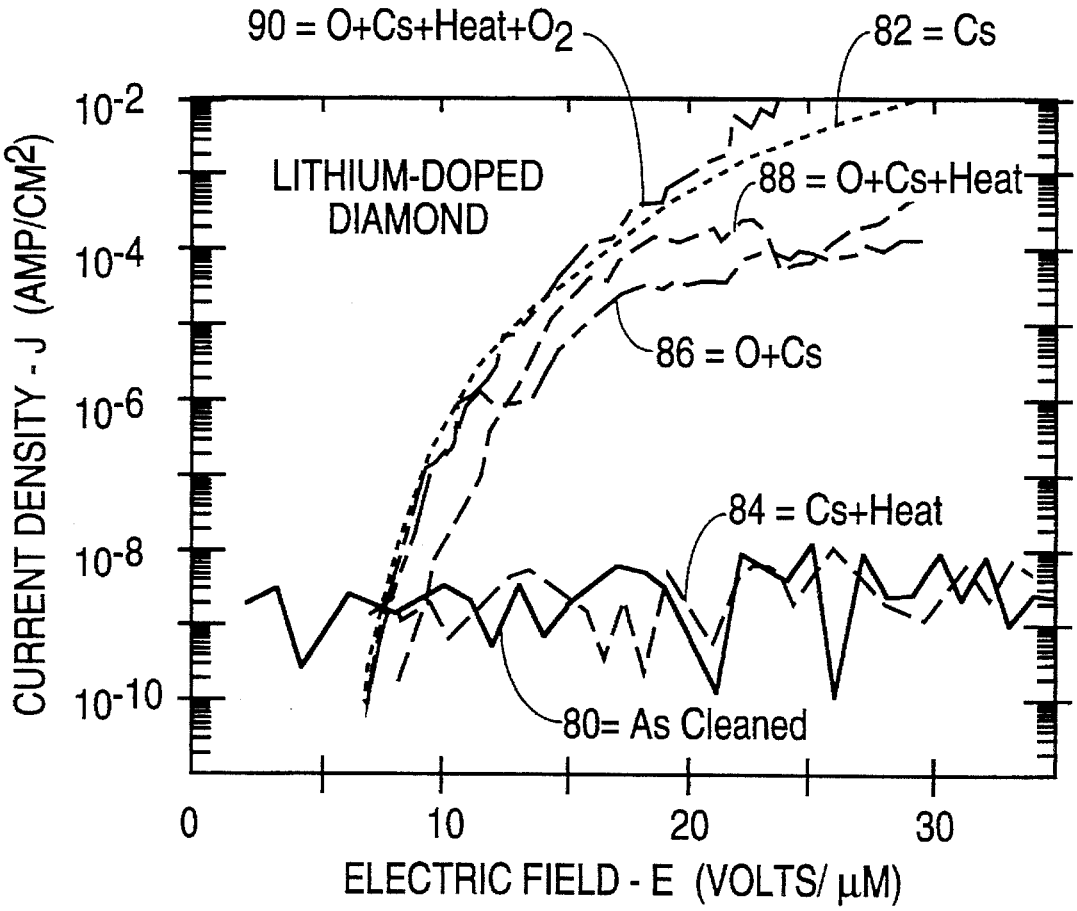
FIGS. 5–7 are graphs for current density as a function of electric field strength for cathode structures prepared according to the invention.

FIG. 5 illustrates current density J measured as a function of electric field E at various points during the fabrication of two types of samples from lithium-doped diamond. One of the types of samples consisted of "normal" Cs-O-C samples in which substrate 10 was subjected to the oxygen plasma followed by Cs deposition using cesium chromate as metal source 62, heating to 200° C., and exposure to molecular oxygen at 1 atm, all in chamber 50 without opening it. The other type of samples consisted of "baseline" Cs-C samples in which Cs deposition was done on a diamond substrate without earlier exposure to the oxygen plasma.

Curve 80 in FIG. 5 is the current density for both types of samples measured directly after cleaning. As indicated by curve 80, the current density before the treatment of the present invention was very low, the variation in curve 80 largely being noise. Curve 82 is the current density for the baseline samples after Cs deposition. The Cs coating caused the current density to increase. Curve 84 is the current density for the Cs-treated baseline samples after the 200° C. heating, the variation in curve 84 also largely being noise. At that point, the current density returned to a very low level, indicating that the cesium had largely evaporated away.

For the normal Cs-O-C samples subjected to the oxygen plasma, curve 86 in FIG. 5 is the current density after Cs deposition. The current density reached a high level. Curve 88 is the current density for the normal samples after the 200° C. heating. As comparison of curves 86 and 88 indicates, the heat treatment caused the current density to rise even more. This indicates that excess Cs atoms evaporated away so as to bring the work function close to its minimum value. Furthermore, unlike the baseline samples, the heating step did not cause the emission characteristics of the normal samples to degrade.

Curve 90 in FIG. 5 is the current density for the normal samples after exposure to molecular oxygen at 1 atm subsequent to the plasma, Cs-deposition, and heating steps. The current density is somewhat greater than that measured directly after the heat treatment.

Samples in which substrate 10 consisted of pre-cleaned laser-ablated graphite were processed in vacuum chamber 50 in the same way as the diamond-substrate samples. As a result of the laser ablation, the graphite included small diamond particles. Cesium, potassium, and barium were separately used as the electropositive metal in the graphite-substrate samples. Cesium chromate, potassium metal, and barium metal were respectively used as metal source 62.

Figure 6:
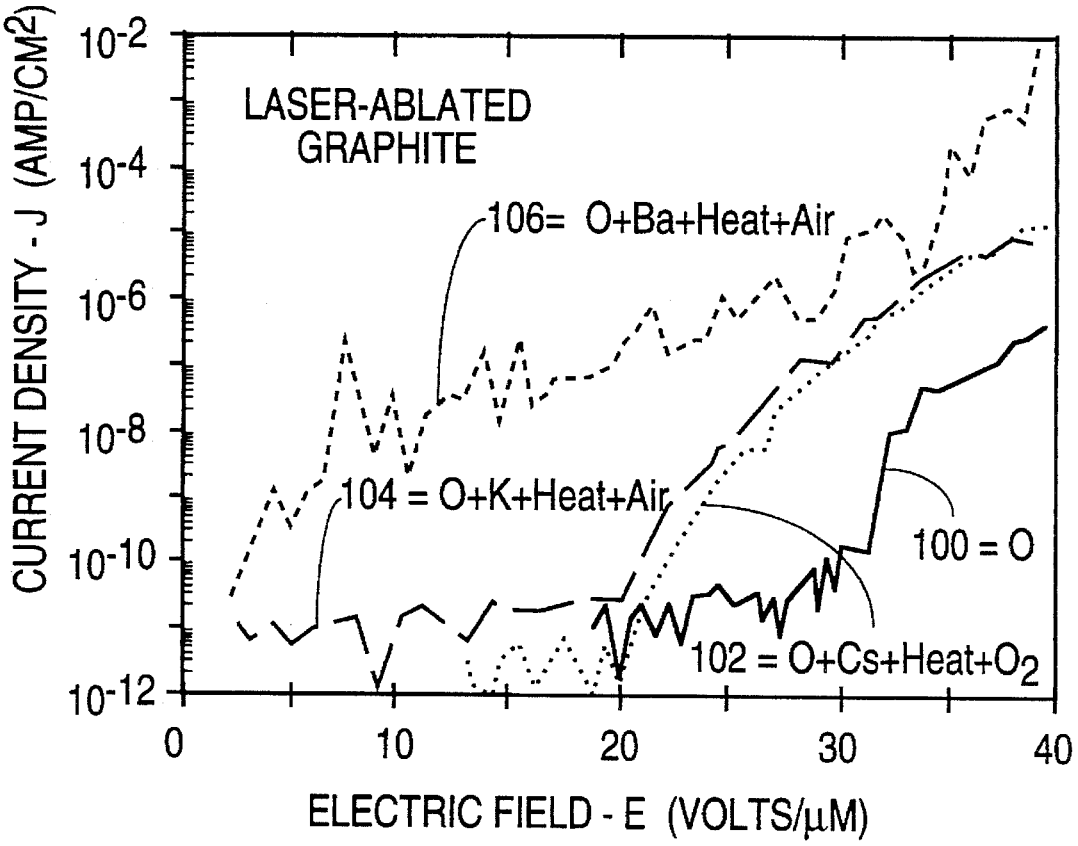

FIG. 6 depicts current-density measurements for the laser-ablated graphite-substrate samples. Curve 100 is the current density after subjection to the oxygen plasma but before metal deposition. As indicated by curve 100, plasma-treated laser-ablated graphite had substantial emissivity prior to metal deposition.

Curve 102 in FIG. 6 is the current density for fully processed Cs-O-C samples after final subjection to molecular oxygen at 1 atm in chamber 50. Curves 104 and 106 respectively are the current densities for fully processed K-O-C and Ba-O-C samples after final subjection to air at 1 atm in chamber 50. As a comparison of curves 102, 104, and 106 to curve 100 indicates, the current density for samples treated with both disassociated oxygen and the electropositive metal was considerably greater than the current density for the samples subjected only to dissociated oxygen.

Samples in which substrate 10 contained amorphous carbon ("a-C") created by burning Novalak photoresist were also processed in vacuum chamber 50 in the same way as the diamond-substrate samples. Cesium, again supplied from cesium chromate, was the electropositive metal in the a-C-substrate samples.

Figure 7:
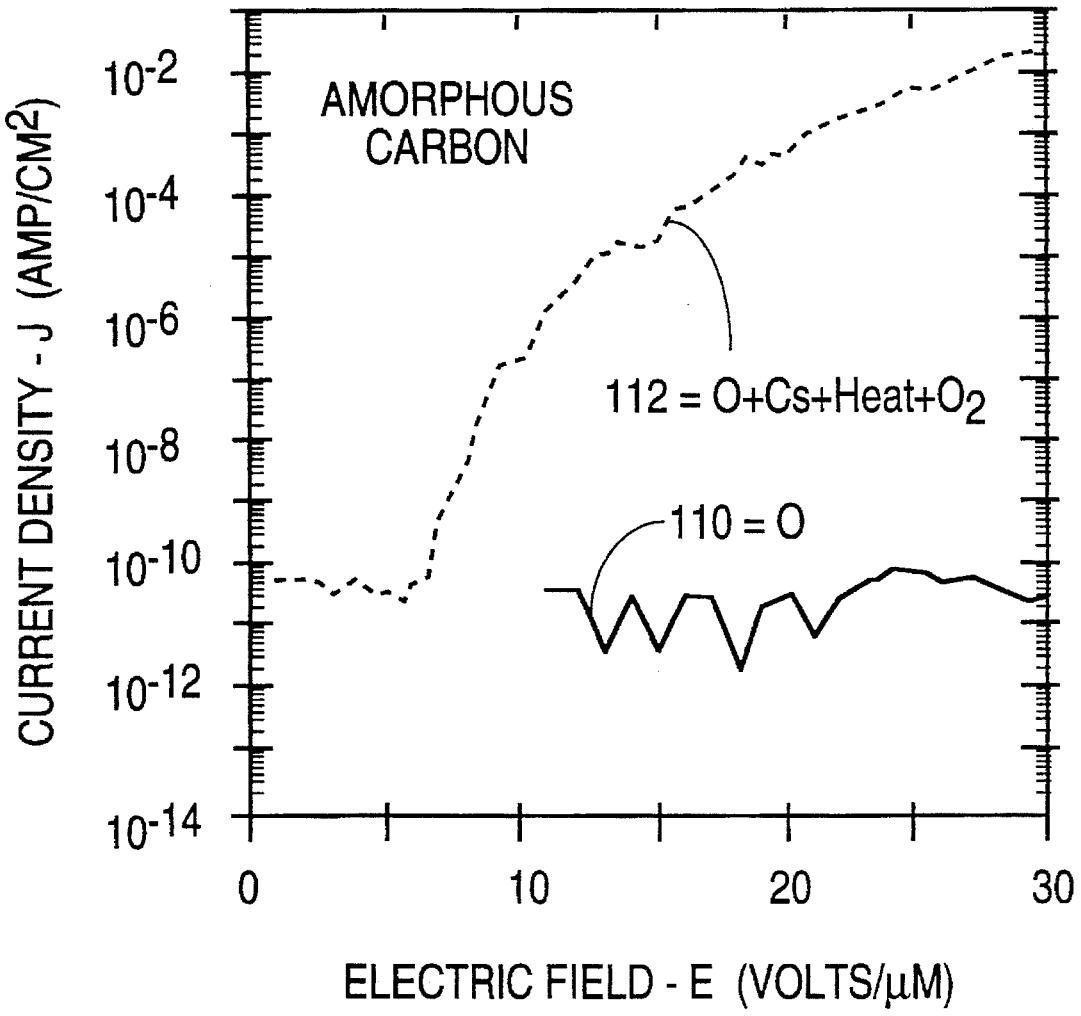
Figure 1A:
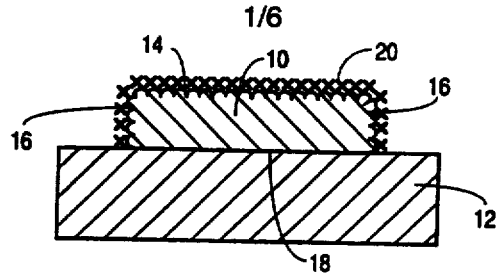
Figure 1B:
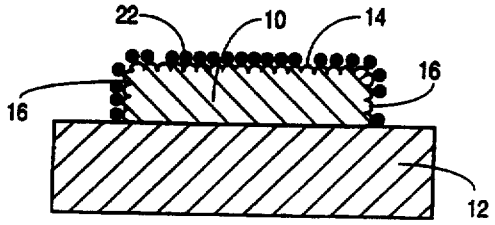
Figure 1D:
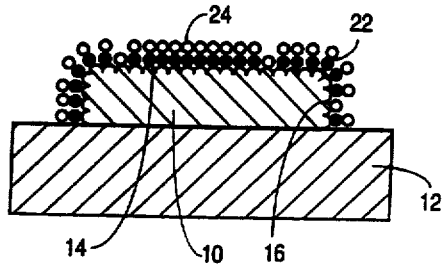
Figure 1D:
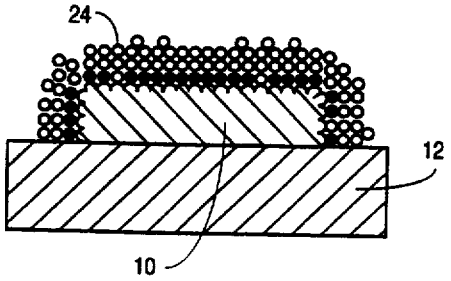
Figure 1D:
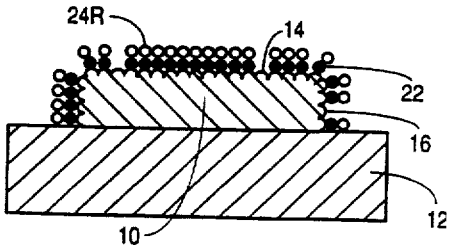
Figure 2A:
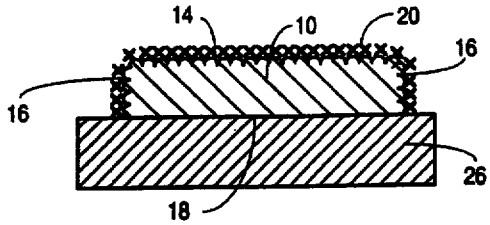
Figure 2B:
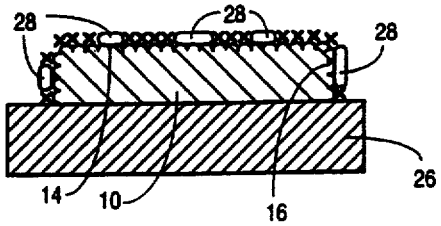
Figure 2C:
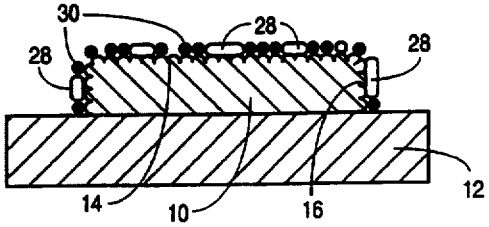
Figure 2E:
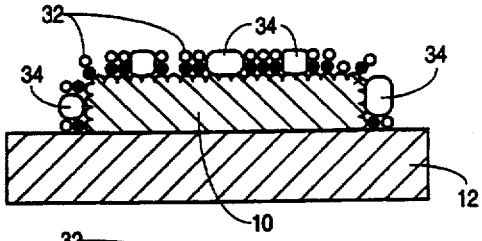
Figure 2E:
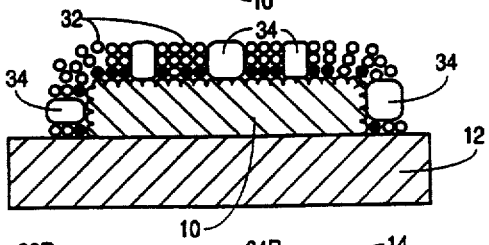
Figure 2E:
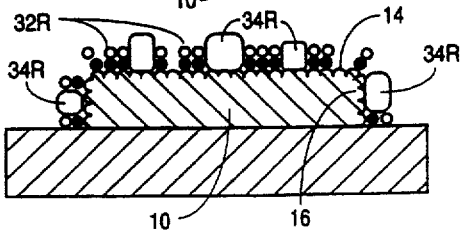

FIG. 7 depicts current-density measurements for a-C-substrate samples. Curve 110 is the current density after exposure to the oxygen plasma but prior to Cs deposition. Curve 112 is the current density for fully processed Cs-O-C samples after final subjection to molecular oxygen at 1 atm in chamber 50. The current density of the completed a-C-substrate samples reached a high level.

While the invention has been described with reference to particular embodiments, this description is solely for the purpose of illustration and is not to be construed as limiting the scope of the invention claimed below. For example, the plasma for subjecting cathode 10 to the electronegative matter could be generated from gas containing one or more compounds of the electronegative matter and other elements. Instead of using a plasma, cathode 10 could be subjected to the electronegative matter in disassociated form by first allowing the electronegative matter to adsorb onto electron-emissive surface 14/16 in molecular form and then heating the molecules or subjecting them to radiation, such as light, in order to cause the molecules of the electronegative matter to dissociate.

The noble-metal sputter deposition could be done in the chamber used for subjecting cathode 10 to the electronegative matter and electropositive metal. Electron-emissive surface 14/16 could be distributed across separate cathode elements in different ways than that illustrated in FIG. 3. Various modifications and applications may thus be made by those skilled in the art without departing from the true scope and spirit of the invention as defined in the appended claims.

We claim:

1. An emissive cathode structure comprising:

at least one carbon-containing electron-emissive cathode;

electronegative atoms chemically bonded to the cathode where the electronegative atoms comprise at least one of oxygen and fluorine; and atoms of electropositive metal chemically bonded to the electronegative atoms.

2. A structure as in claim 1 further including regions of an alloy of atoms of noble metal and the electropositive metal situated over parts of the cathode in between parts of the cathode covered by the electronegative atoms.

3. An emissive cathode structure comprising:

at least one carbon-containing cathode having an electron-emissive surface, the cathode being at least 50 atomic percent carbon along the electron-emissive surface;

electronegative atoms chemically bonded to the cathode along a specified area of the electron-emissive surface, the electronegative atoms comprising at least one of oxygen and fluorine; and atoms of electropositive metal chemically bonded to the electronegative atoms along the specified area.

4. A structure as in claim 3 wherein the cathode consists substantially of carbon along the electron-emissive surface.

5. A structure as in claim 3 wherein the carbon along the electron-emissive surface is primarily in at least one of diamond, graphite, and amorphous form.

6. A structure as in claim 3 wherein the carbon along the electron-emissive surface comprises at least one of n-doped and p-doped diamond.

7. A structure as in claim 3 wherein the carbon along the electron-emissive surface comprises diamond doped with at least one of nitrogen, lithium, and sulfur.

8. A structure as in claim 3 wherein the carbon along the electron-emissive surface comprises carbon-implanted diamond.

9. A structure as in claim 3 wherein the carbon along the electron-emissive surface comprises laser-modified diamond.

10. A structure as in claim 3 wherein the electronegative atoms largely form a monolayer over the specified area.

11. A structure as in claim 10 wherein the atoms of the electropositive metal largely form a monolayer over the specified area.

12. A structure as in claim 3 wherein the electropositive metal comprises at least one of lithium, sodium, potassium, rubidium, cesium, barium, scandium, yttrium and lanthanum.

13. A structure as in claim 3 further including regions of an alloy of atoms of gold and the electropositive metal situated over parts of the electron-emissive surface exclusive of the specified area.

14. A structure as in claim 3 wherein the cathode structure comprises a plurality of separate cathodes.

15. A structure as in claim 3 wherein the structure is capable of substantially withstanding exposure to atmospheric air.

16. A structure as in claim 3 wherein the structure is capable of substantially withstanding a temperature of at least 200° C. under high vacuum.

17. A structure as in claim 16 wherein the structure is capable of withstanding exposure to oxygen subsequent to being subjected to the temperature of at least 200° C.

18. A structure as in claim 3 wherein the structure is capable of substantially withstanding exposure to atmospheric air for at least 5 minutes.

19. A structure as in claim 3 wherein the structure is capable of substantially withstanding exposure to atmospheric air for at least 1 day.

20. A structure as in claim 3 wherein the structure is capable of substantially withstanding a temperature of at least 280° C. for at least 10 minutes under high vacuum.

21. A structure as in claim 3 wherein the structure is capable of substantially withstanding a temperature of at least 400° C. for at least 10 minutes under high vacuum.

22. A structure as in claim 1 wherein the structure is capable of substantially withstanding exposure to atmospheric air.

23. A structure as in claim 1 wherein the structure is capable of substantially withstanding a temperature of at least 200° C. under high vacuum.

24. A structure as in claim 23 wherein the structure is capable of withstanding exposure to oxygen subsequent to being subjected to the temperature of at least 200° C.

* * * * *

UNITED STATES PATENT AND TRADEMARK OFFICE
CERTIFICATE OF CORRECTION

PATENT NO. : 5,463,271
DATED : October 31, 1995
INVENTOR(S) : Geis et al

It is certified that error appears in the above-identified patent and that said Letters Patent is hereby corrected as shown below:

The title page should be deleted and substitute therefor the attached title page.

Delete sheets 1 and 2 and substitute therefor the drawing sheets, consisting of shts. 1 and 2 as shown on the attached pages.

Signed and Sealed this

Thirty-first Day of December, 1996

*Attest:*

*Attesting Officer*

Bruce Lehman

BRUCE LEHMAN

*Commissioner of Patents and Trademarks*

United States Patent [19]

Geis et al.

[11] Patent Number: 5,463,271

[45] Date of Patent: Oct. 31, 1995

[54] STRUCTURE FOR ENHANCING ELECTRON EMISSION FROM CARBON-CONTAINING CATHODE

[75] Inventors: Michael W. Geis, Acton, Mass.; John M. Macaulay, Palo Alto, Calif.; Jonathan C. Twichell, Acton, Mass.

[73] Assignees: Silicon Video Corp., Cupertino, Calif.; Massachusetts Institute of Technology, Cambridge, Mass.

[21] Appl. No.: 90,228

[22] Filed: Jul. 9, 1993

[51] Int. Cl.[6] ..... H01J 1/30; H01J 19/24

[52] U.S. Cl. ..... 313/346 R; 313/310; 257/77; 257/11

[58] Field of Search ..... 313/346 R, 346 DC, 313/310, 345, 355, 270, 337, 311, 336, 351; 257/77, 103, 10, 11, 12

[56] References Cited

U.S. PATENT DOCUMENTS

| | | | |
|---|---|---|---|
| 4,411,827 | 10/1983 | Corneille | 252/521 |
| 4,663,559 | 5/1987 | Christensen | 313/346 R X |
| 5,019,003 | 5/1991 | Chason | 445/24 |
| 5,089,292 | 2/1992 | Macaulay et al. | 313/346 R X |
| 5,180,951 | 1/1993 | Dworsky et al. | 313/346 R X |
| 5,190,796 | 3/1993 | Incovangelo | 427/304 |
| 5,202,571 | 4/1993 | Hirabayashi et al. | 313/346 R X |

OTHER PUBLICATIONS

Langmuir, "Oxygen Films on Tungsten. I. A Study of Stability by Means of Electron Emission in Presence of Cesium Vapor," *J. Amer. Chem. Soc.*, Feb. 1931, pp. 487–497.

Lin, "The role of oxygen and fluorine in electron emission of some kinds of cathodes," *J. Vac. Sci. Technol.*, May/Jun. 1988, pp. 1053–1057.

Macaulay et al, "Cesiated thin-film field-emission microcathode arrays," *Appl. Phys. Lett.*, 24 Aug. 1992, pp. 997–999.

Rougeot et al, "Negative Electron Affinity Photoemitters," *Adv. Electronics & Electron Phys.*, vol. 48, 1979, pp. 1–36.

Levine, "Structural and Electronic Model of Negative Electron Affinity on the Si/Cs/O Surface," *Surf. Sci.*, 1973, pp. 90–107.

Kultashev, "Effect of Oxygen On The Work Function of Films of Electropositive Metals Adsorbed on 4D– And 5D–Transition Metals," *Izevestiya Akademii Nauk SSSR, Seriya Fizicheskaya*, 1976, pp. 2478–2483.

Spicer et al, "Studies of the Semiconducting Properties of the Compound CsAu," *Physical Rev.*, 1 Jul. 1959, pp. 57–62.

Wertheim et al, "Electronic Structure of CsAu," *Solid State Coms.*, vol. 30, 1979, pp. 473–475.

Koenig et al, "Electronic Properties of alkali–metal–gold compounds," *Physical Rev. B*, 15 Jun. 1984, pp. 6481–6488.

*Primary Examiner*—Sandra L. O'Shea
*Assistant Examiner*—Ashok Patel
*Attorney, Agent, or Firm*—Skjerven, Morrill, MacPherson, Franklin & Friel; Alan H. MacPherson; Ronald J. Meetin

[57] ABSTRACT

A cathode structure contains electronegative atoms (22), which consist of oxygen and/or fluorine, chemically bonded to a carbon-containing cathode (10). Atoms (24R) of electropositive metal are chemically bonded to the electronegative atoms. The combination of the electropositive metal atoms and the electronegative atoms enhances the electron emissivity by reducing the work function.

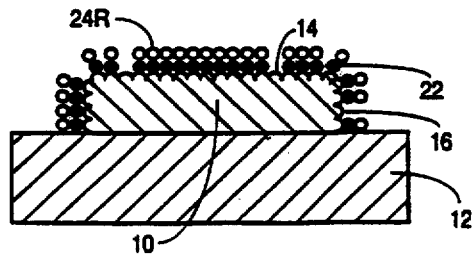

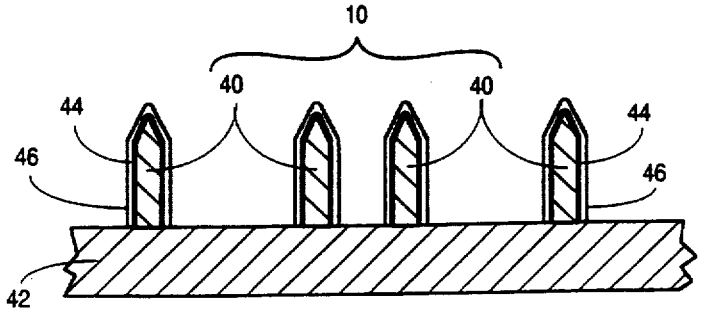

24 Claims, 6 Drawing Sheets